United States Patent [19]

Stuiber et al.

[11] 4,198,169

[45] Apr. 15, 1980

[54] TYPE DISC PRINTER

[75] Inventors: Walter Stuiber, Karben; Manfred Mansfeld; Heinz Geis, both of Frankfurt; Friedrich Teichmann, Feucht, all of Fed. Rep. of Germany

[73] Assignee: Adlerwerke vorm. Heinrich Kleyer A.G., Nuremberg, Fed. Rep. of Germany

[21] Appl. No.: 939,951

[22] Filed: Sep. 6, 1978

[51] Int. Cl.[2] ..... B41J 1/30

[52] U.S. Cl. ..... 400/144.2; 400/52

[58] Field of Search ..... 400/134.1, 134.2, 138.3, 400/144.1–144.3, 477; 101/93.19

[56] References Cited

U.S. PATENT DOCUMENTS

| | | | |
|---|---|---|---|
| 2,161,840 | 6/1939 | Adams | 400/144.2 X |
| 2,236,663 | 4/1941 | Adams | 400/144.2 |
| 3,542,182 | 11/1970 | Langenberger | 400/144.3 X |
| 3,677,386 | 7/1972 | Herterich et al. | 400/144.2 |
| 4,128,346 | 12/1978 | Ragland | 400/144.2 |

FOREIGN PATENT DOCUMENTS

| | | | |
|---|---|---|---|
| 2158263 | 5/1972 | Fed. Rep. of Germany | 400/144.2 |

*Primary Examiner*—Paul T. Sewell
*Attorney, Agent, or Firm*—Joseph R. Spalla

[57] ABSTRACT

An electromechanical printer having characters of a type font located on radial spokes of a circular type disc is disclosed. The type disc is normally arrested and connected to be driven about its axis by a unidirectional motor source via a slip clutch. Selection-print activating mechanism responsive to source, e.g. keyboard, generated mechanical outputs serve to select a character stop, in an assembly of character stops, corresponding to characters located on the spokes of the type disc and, incident to selection of a character stop, to release the normally arrested type disc. The type disc is provided with counterstops adapted to engage selected character stops positioned in the path thereof and to move the character stop assembly to a frame supported final positioning stop which arrests the type disc with the selected character opposite a print point. The encounter of the character stop assembly with the final positioning stop is employed to operate a print hammer to drive the selected character against a platen to print. Following printing, means are provided to reset selected character stops and to restore the character stop assembly to normal position.

8 Claims, 7 Drawing Figures

TYPE DISC PRINTER

This invention relates to a single element printer; more particularly, it relates to a single element printer having characters located on radial spokes of a type disc, and specifically, it relates to character selection-print activating mechanisms to position and to print selected characters.

Type disc printers known to the art and presently offered employ elaborate electronics to control character selection and imprint and as a result do not employ components such as are found in mechanical and electromechanical printers.

In accordance with the present invention, a type disc printer, composed substantially of mechanical elements, is provided which can be manufactured with the tools and skills existing in conventional mchanical typewriter manufacturing facilities. More particularly, it relates to a single element printer having characters located on radial spokes of a type disc, and specifically, it relates to character selection-print activating mechanisms to position and to print selected characters.

An object of the invention is to provide an electric type disc printer which, except for motors, switches and solenoids, is essentially mechanical.

Another object of the invention is in the provision of an electric type disc printer having character selection mechanism responsive to mechanical input signals which initiate character selection and print actuation sequences.

Other objects, features and advantages of the present invention will become known to those skilled in the art from a reading of the following detailed description when taken in conjunction with the accompanying drawing wherein like reference numerals designate like or corresponding parts throughout the drawing.

IN THE DRAWING

Figure 1:
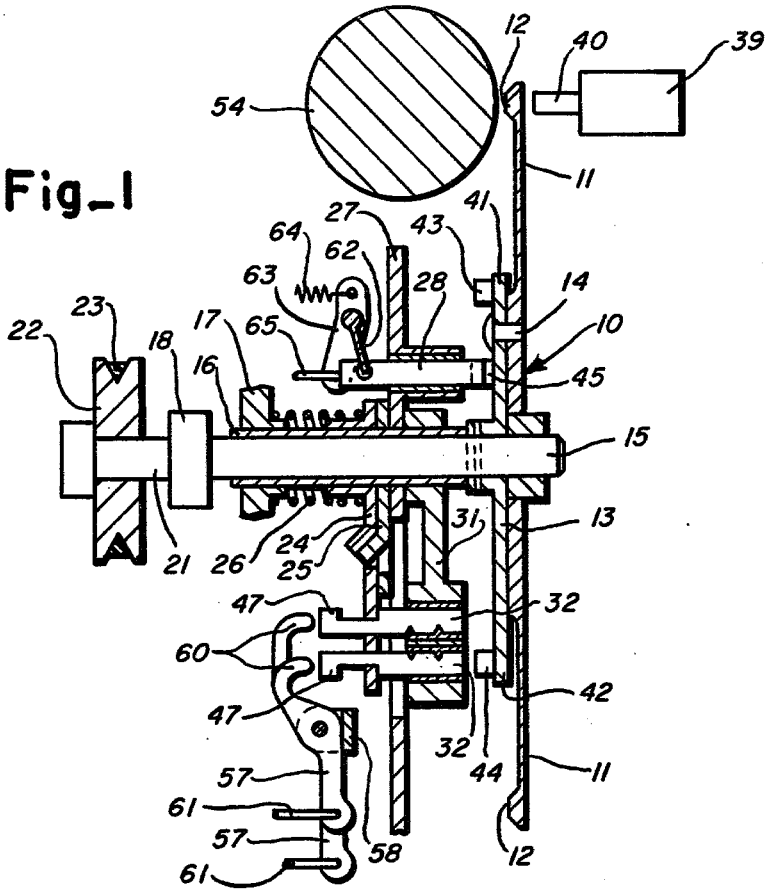
FIG. 1 is a sectional view of a type disc and selection-print activating mechanism therefor of a printer in accodance with the invention taken along lines 1—1 of FIG. 2.
Figure 2:
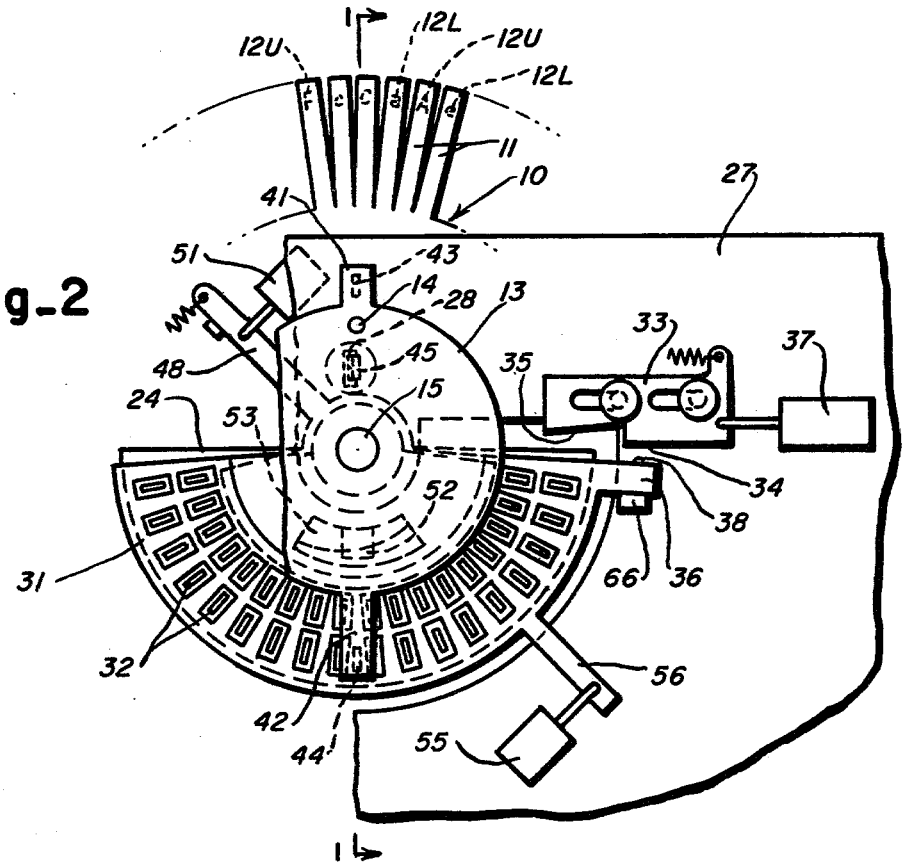
FIG. 2 is a front view of a type disc printer in accordance with the invention with portions of the type disc broken away showing additional associated elements.

Referring now to the drawing, there is shown in FIGS. 1 and 2 a circular type disc generally designated by reference numeral 10 having radial spokes 11 at the ends of which are located upper and lower case characters 12 comprising a type font. As noted in FIG. 2, upper case characters 12U alternate with lower case characters 12L with the spokes 11 bearing upper case characters 12U adjacent the spokes 12L bearing corresponding lower case characters 12L.

The type disc 10 is removably secured by suitable means to a disc mounting plate 13 and located relative thereto at a particular orientation as by a pin 14. The motive source for the disc mounting plate 13 and connected type disc 10 comprises a central shaft 15 which is supported for rotation in a sleeve bearing 16 fixed to a frame 17. The left end of the shaft 15, as viewed in FIG. 1, is coupled via a slip clutch 18 to an input shaft 21 supported on a frame portion (not shown). A pulley 22 is secured to the input shaft 21 and is connected to be continuously driven by an electric motor driven belt 23.

Figure 3:
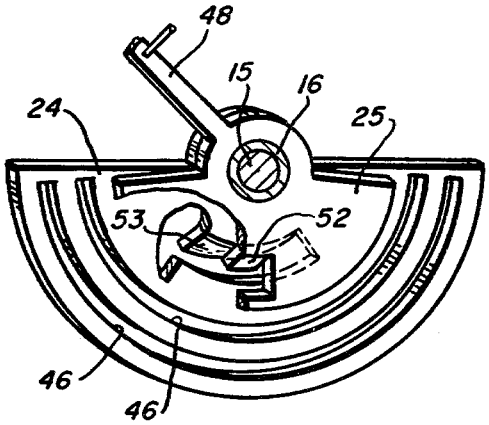
FIG. 3 is a perspective view of character stop reset mechanism shown in FIGS. 1 and 2.

A generally semi-circular character stop reset plate 24, shown in perspective in FIG. 3, is keyed to the outer periphery of the sleeve bearing 16 for axial movement relative thereto. To the right of the reset plate 24, as viewed in FIGS. 1 and 3, is a generally semi-circular cam plate 25 which is rotatably mounted on the sleeve bearing 16. A coiled spring 26 is mounted about the sleeve bearing 16 between frame 17 and the flange of the reset plate 24 to bias the reset plate 24 and cam plate 25 against a frame supported mounting plate 27 through which the sleeve bearing 16 extends and is supported thereby. The mounting plate 27 supports an axially movable type disc home stop 28 which extends toward the type disc mounting plate 13. To the right of the mounting plate 27, the sleeve bearing 16 also rotatably supports, as by a friction fit, a character stop plate 31 of substantially semi-circular configuration. The character stop plate 31 supports two radial spaced array of angularly disposed axially movable character stops 32.

As viewed in FIG. 2, the mounting plate 27 supports a shiftable final stop 33 having a lower case abutment 34 and an upper case abutment 35 spaced one character division. The lower case abutment 34 normally overlies the path of a radially extending arm 36 of the character stop plate 31. FIG. 2 shows the final stop 33 in lower case position with the arm 36 on character division from the lower case abutment 34. The shiftable final stop 33 is connected for operation by a shift solenoid 37 which, when energized by a signal from a keyboard or other source, will move the final stop 33 so that the upper case abutment 35 is in the path of the arm 36. Arm 36 also supports a normally open microswitch 38 which, when closed, energizes a print hammer solenoid 39.

As shown in FIG. 1, the right end of the shaft 15 is secured to the disc mounting plate 13 to which the type disc 10 is removably secured.

As viewed best in FIG. 2, the circular disc mounting plate 13 has two 180° spaced radially extending arms 41 and 42. The arm 41 supports a counterstop 43 which is associated with the inner array of character stops 32 and the arm 42 carries a counterstop 44 for engaging the outer radial array of character stops 32 on character stop plate 31. A third counterstop 45 is provided on the disc mounting plate 13 positioned radially inward of and aligned with counterstops 43 and 44 and serves to engage the normally positioned home stop 28 to hold the type disc 10 arrested against rotation.

As noted earlier, the characters 12 are arranged on the spokes 11 of the type disc 10 with each lower case type character 12 followed by its corresponding upper case type as shown in FIG. 2. Each character stop 32 corresponds to two character spokes 11 with the inner array of character stops 32 corresponding to spokes 11 located in the 180° segment of the type disc 10 extending from 3 o'clock to 9 o'clock, and the outer array to spokes 11 located in the other 180° segment of the type disc extending from 9 o'clock to 3 o'clock as viewed in FIG. 2.

As shown in FIG. 1, the character stops 32 supported in the character stop plate 31, extend to the left through annular grooves 46 (FIG. 3) in the reset plate 24 and at the leftmost ends are formed with hooks 47 which, when the stops 32 are in set positions, will be movable to the unset positions illustrated in FIG. 1 by leftward movement of the reset plate 24 in response to rotation of the cam plate 25. With reference to FIGS. 2 and 3, the cam plate 25 has a radial extension 48 which is connected at its end to a reset solenoid 51 which, when energized, will rotate the cam plate 25.

As best seen in FIG. 3, the cam plate 25 is formed with an axially projecting bent-out lug 52 for engagement with an axially inclined surface 53 formed on the reset plate 24 whereby when the cam plate 25 is rotated the camming action of lug 52 on surface 53 forces the reset plate 24 to axially shift in a character stop reset direction against the force of coil spring 26.

Figure 4:
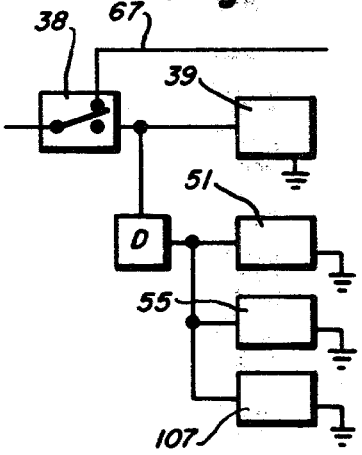
FIG. 4 is a circuit diagram.

As shown in FIG. 4, switch 38 on arm 36 is connected in the circuit of the hammer solenoid 39 which will be energized upon closure of switch 38 whereby its armature 40 will impact a selected character bearing type spoke 11 against a platen 54. The switch 38 is also connected in a circuit including a delay circuit D whereby after a delay to allow time for printing, its closure will effect the energization of the character stop reset solenoid 51 and the energization of a character stop plate restore solenoid 55 mounted on plate 27 and connected to an arm 56 radially extending from the character stop plate 31.

With reference again to FIG. 1, each character stop 32 is associated with a crank arm 57 pivoted intermediate the ends thereof in a semi-circular segment 58. The lower ends are coupled to selection wires or links 61 operable mechanically or by solenoids from a keyboard or other signal source. In response to a pull on a wire 61, the associated crank 57 will be rocked clockwise as viewed in FIG. 1 whereby its upper end will engage and axially move its associated character stop 32 toward the type disc 10 to set position for encounter with a counterstop 43 or 44 as the case may be.

The home stop 28 is associated with and coupled for axial retraction from the path of counterstop 45 by a frame pivoted bail 62. An arm 63 is secured to bail 62 and its upper end is connected to a spring 64 which normally biases the bail 62 and home stop 28 to the arresting position shown in FIGS. 1 and 2. A signal wire or link 65 is connected to the lower end of arm 63 and is operative when pulled to the left as directed by a source to retract the home stop 28 to the left thereby to release type disc 10 for rotation.

Operation

With the power switched on, the home stop 28 is in the path of counterstop 45 (FIG. 2). This normally holds the type disc 10 arrested and the clutch 18 will slip. In response to a character selection signal as from a keyboard or other source, a selected wire 61 will be pulled to rock its associated crank 57 whereby its upper end 60 will axially move a character stop 32 to the right as viewed in FIG. 1 to a set position. Incident to each character stop setting action, wire 65 will also be pulled and will operate to withdraw the home stop 28 to release the type disc for rotation by the motor through the slip clutch 18. The type disc 10 will rotate until one or the other counterstops 43 or 44 encounters the selected set character stop 32. This encounter will cause the character stop plate 31 to rotate until, assuming a lower case character, arm 36 encounters final stop abutment 34 and is arrested. With the final stop 33 in upper case position, character stop plate 31 will move an additional character division before arrest by the upper case abutment 35 to effect printing of an upper case character. On arrest of the character stop plate 31, switch 38 will close to energize hammer solenoid 39 whereby the character corresponding to the selected stop 32 will be impacted and, after a delay, to energize the reset and restore solenoids 51 and 55 thereby to reset the character stop 32 incident to rotation of cam plate 25, and to restore the character stop plate 31 to a home abutment 66 at which time a signal to a source to issue another character stop selection signal can be given. Such a signal to the source can be issued over line 67 (FIG. 4) connected to the back contact of switch 38.

Figure 5:
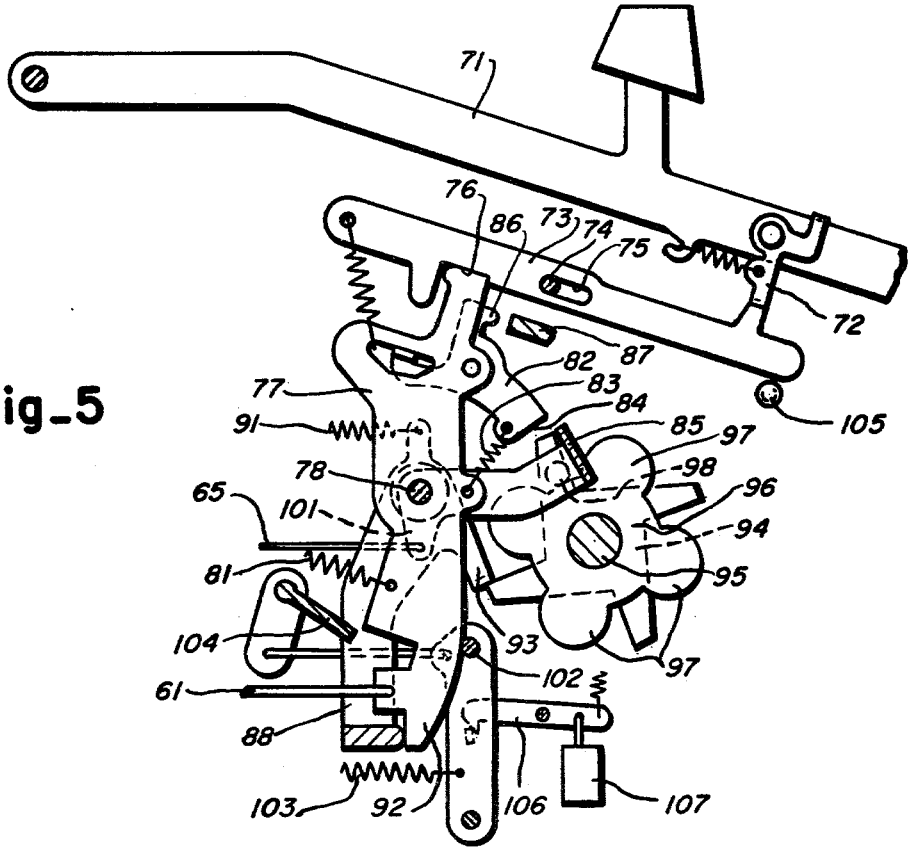
FIG. 5 is an elevational view of a keyboard mechanism for generating the outputs necessary to control the selection-print activating mechanism of FIGS. 1 and 2.
Figure 6:
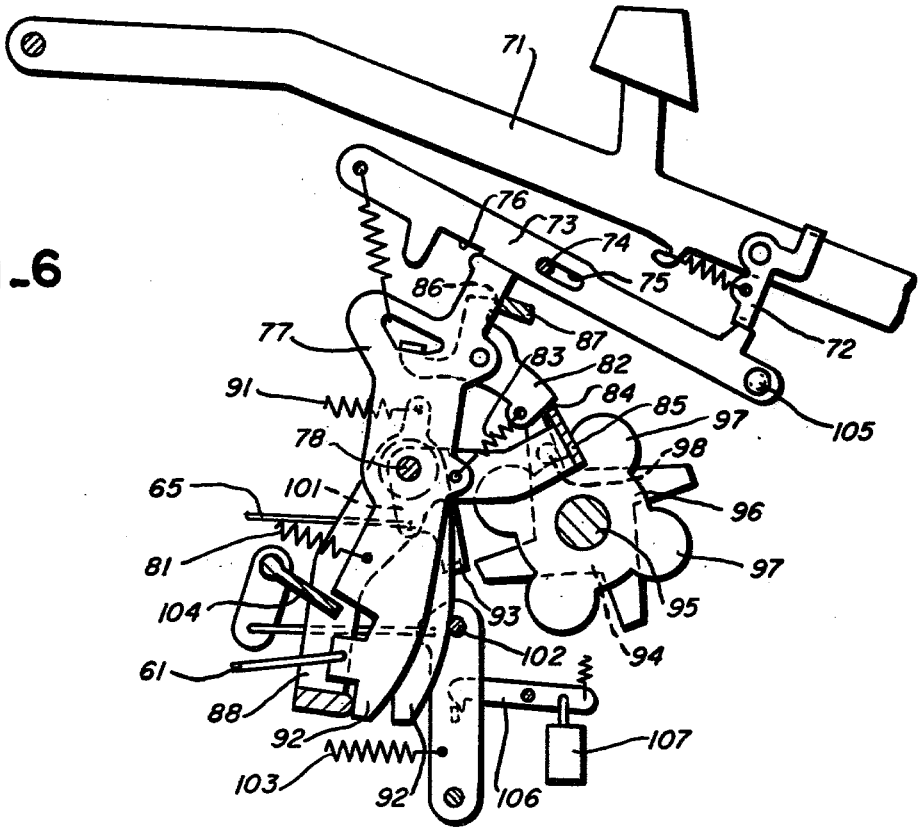
FIGS. 6 and 7 are views similar to FIG. 5 showing sequential active positions of the parts.
Figure 7:
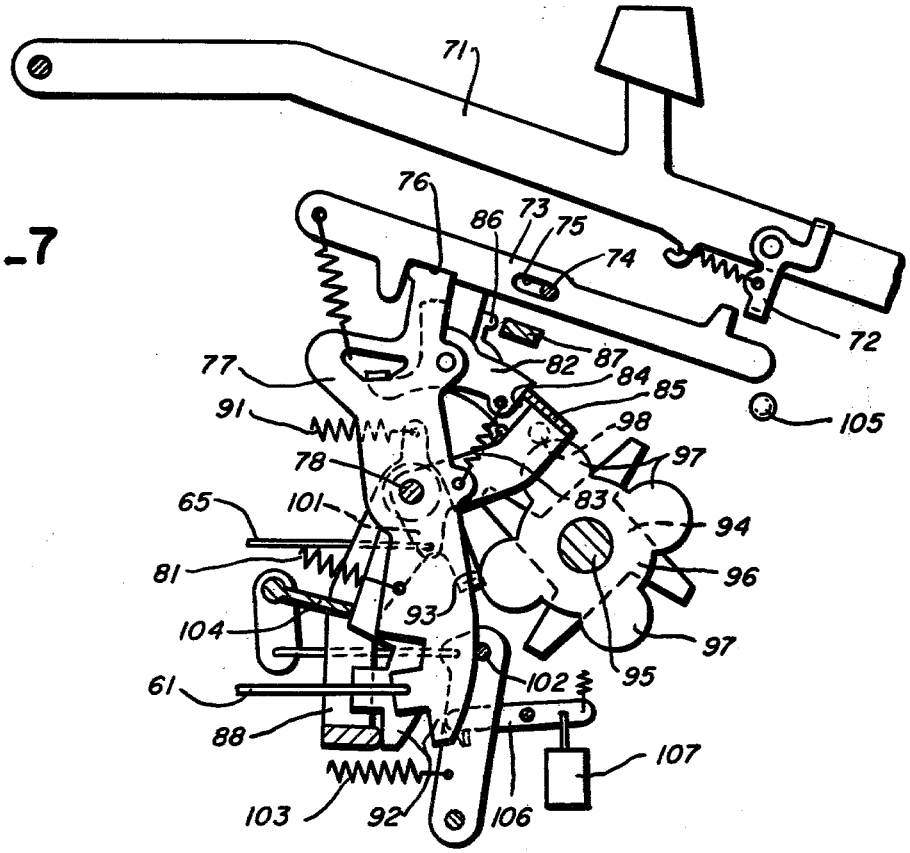

The source of signals may be a keyboard as shown in FIGS. 5–7 to which reference is now directed. The keyboard comprises a plurality of keylevers 71, only one of which is shown. Each keylever 71 is pivoted at one end and carries a by-pass lever 72 which, upon keylever depression, rocks a lever 73 clockwise about a rod 74 which extends into a slot 75 intermediate the ends of lever 73. The lower edge of lever 73 has a notch 76 which normally holds the upper end of a sublever 77, which is pivoted intermediate its ends about a frame supported pivot rod 78, from moving clockwise under the urge of a spring 81 connected to bias the sublever 77 clockwise as viewed in FIG. 5. The sublever 77 also pivotally supports a coupling lever 82 which is normally biased by a spring 83 to hold an edge 84 thereof out of the path of a common drive bail 85 rotatably mounted on pivot rod 78. Upon release and clockwise movement of the sublever 77, a nose 86 on coupling lever 82 will move into engagement with an abutment 87 and cause the coupling lever 82 to rock counterclockwise and thereby to position the edge 84 thereof in position to be driven by the common bail 85 as shown in FIG. 6. Pivot rod 78 also supports a second bail 88 located in the clockwise path of and is biased by a return spring 91 against the lower end 92 of sublever 77. Bail 88 will be rocked by the clockwise movement of the released sublever 77 and an arm 93 thereof will move out of the path of a tooth of a four toothed clutch member 94. The release of the clutch member 94 will allow a motor driven shaft 95 to drive the clutch member 94 and a cam 96 having four lobes 97. A lug 98, provided on bail 85, will be engaged by a cam lobe 97 to drive the bail 85 which in turn will encounter edge 84 of coupling lever 82 and drive the coupling lever 82 and associated sublever 77 counterclockwise about pivot rod 78 as shown in FIG. 7. The counterclockwise movement of drive bail 85 and sublever 77, respectively, will pull wire 65 connected to an arm 101 of drive bail 85, and will pull a selected wire 61 connected to the lower end of the sublever 77 to thereby select a stop 32 and retract home stop 28. Upon restoration of drive bail 85, the home stop 28 will be returned to the position shown in FIG. 1 by spring 64.

As shown in FIG. 5, a common bail 102 biased counterclockwise by a spring 103 is located in the counterclockwise path of the lower end 92 of the sublevers 77 for operation by a selected drive sublever 77. The common bail 102 is linked to a memory bail 104 common to all of the sublevers to move it into the clockwise path of all of the sublevers 77 incident to the counterclockwise movement of a first selected sublever 77 as shown in FIG. 7. In that a second keylever 71 can be depressed after the lever 73, rotated by a first depressed keylever 71, has been driven from a ball block 105, the sublever 77 associated with the second depressed keylever 71 will be released from the notch 76 in its associated lever 73, but will encounter the memory bail 104 after a limited clockwise movement. This limited clockwise movement of the sublever 77 and the bail 88 is sufficient to hold the second sublever 77 in memory but insufficient to move the arm of bail 88 out of the path of the teeth of the clutch member 94 and to cause interference of the second coupling lever 82 with the cam driven bail 85 driving the first sublever as shown in FIG. 7. The common bail 102 when moved by the counterclockwise first driven sublever 77 to its maximum, is retained by a latch 106 to maintain the memory bail 104 in a blocking position until the closure of switch 38 energizes a solenoid 107 which, when energized, will release the latch 106 to allow return movement of the common bail 102 and the movement of the memory bail 104 to the position, shown in FIG. 5, or as permitted by the return movement of the first sublever 77, if the solenoid 107 is energized earlier. The return of the memory bail 104 to the FIG. 5 position will allow the second released sublever 77 in memory to move further clockwise sufficient to position its coupling lever 82 in the path of the common power bail 85 and via arm 93 of bail 88 to release the clutch member 94 whereby the second character signals may be issued to the printer.

The time between selection of a character stop 32 and printing depends on the angular distance of the selected character stop 32 from a counterstop 43 or 44, as the case may be. Thus, when the keyboard is employed as a signal source, shaft 15, whose rotation begins with completion of character stop selection midway of a quarter revolution of shaft 95, will be required to make a revolution within the time of a quarter revolution of shaft 95 to assure the restoration of the character stop plate 31 before a second character selection can occur.

The invention claimed is:

1. A type disc printer having a frame, a drive shaft and a driven shaft rotatably supported in said frame, a slip clutch coupling said drive and driven shafts, type disc means secured to said driven shaft, said type disc means having axially flexible radial spokes with type characters thereon, home stop means on said frame and said type disc means for releasably holding said driven shaft against rotation, a type character stop plate having an array of angularly located character stops corresponding to type characters on said spokes, said stops being supported for axial movement from unset to set positions, said type character stop plate being supported on said frame for limited rotation to a final stop position from a rest position, means for moving a selected character stop to a set position, counterstop means on said type disc means for engaging character stops in set position and for carrying said character stop plate to said final stop position whereat rotation of said type disc means is arrested at the selected type character, means for momentarily moving said home stop means to release said type disc means for rotation to a selected set character stop, means for restoring said character stop plate to rest position, means for resetting selected character stops to unset position, an impact hammer, and means responsive to movement of said character stop plate to its final stop position for operating said impact hammer to drive an oppositely located spoke to print, and for operating said character stop resetting means, and said characters stop plate restoring means.

2. A type disc printer as recited in claim 1, said means for operating a character stop to set position comprising a plurality of cranks pivotally supported on said frame, and means responsive to source generating signals and connected to rock said cranks into engagement with and to move an associated character stop to set position.

3. A type disc printer as recited in claim 2, including source means for generating character stop setting signals and a home stop means moving signal.

4. A type disc printer as recited in claim 3, said source means comprising a keyboard having a keylever, and means responsive to keylever depression for generating signals to move said home stop means and set a character stop.

5. A type disc printer as recited in claim 1, including circuit means responsive to restoration of said character stop plate for signaling said source means to issue subsequent character stop setting and home stop means moving signals.

6. A type disc printer as recited in claim 1, said means for restoring character stops to unset position comprising a reset plate mounted for axial movement relative to said character stop plate and operative incident to axial movement to move character stops from set to unset position, and cam means rotatably supported on said frame for moving said reset plate incident to rotation of said cam means.

7. A type disc printer as recited in claim 1, each of said character stops corresponding to two spokes of said type disc means, and adjacent spokes carrying a lower case type character and its corresponding upper case type character, and said final stop position of said character stop plate being defined by a radial arm extending from said character stop plate and by a shiftable member mounted on said frame having upper and lower case abutments positionable into the path of said radial arm of said character stop plate.

8. A type disc printer as recited in claim 7, said means responsive to movement of said character stop plate to said final stop position comprising, circuit means including a switch mounted on said radial arm for closure at said final stop position, and solenoids adapted to be energized upon closure of said switch for operating said impact hammer, said character stop resetting means and said character stop plate restoring means.

* * * * *